United States Patent [19]

Mahler et al.

[11] 4,223,029

[45] Sep. 16, 1980

[54] FABRIC SOFTENING PRODUCT AND METHOD OF USE IN DRYER

[75] Inventors: Darrell G. Mahler; Charles Doumani, both of Los Angeles, Calif.

[73] Assignee: Blue Cross Laboratories, North Hollywood, Calif.

[21] Appl. No.: 649,349

[22] Filed: Jan. 15, 1976

[51] Int. Cl.[2] ..... B05D 3/12; B65D 85/70

[52] U.S. Cl. ..... 427/242; 34/9; 34/12; 34/72; 206/0.5; 206/524.1; 206/524.6

[58] Field of Search ..... 427/242; 206/0.5, 84, 206/524.1, 524.6; 34/12, 72, 9

[56] References Cited

U.S. PATENT DOCUMENTS

| | | | |
|---|---|---|---|
| 3,435,537 | 4/1969 | Rumsey, Jr. | 34/72 |
| 3,442,692 | 5/1969 | Gaiser | 427/240 |
| 3,507,690 | 4/1970 | Walker | 428/264 |
| 3,681,241 | 8/1972 | Rudy | 252/8.75 |
| 3,948,387 | 4/1976 | Haertle | 209/0.5 X |
| 3,956,556 | 5/1976 | McQueary | 427/242 X |
| 3,967,008 | 6/1976 | Mizuno et al. | 427/242 |

*Primary Examiner*—Evan K. Lawrence
*Attorney, Agent, or Firm*—Louis J. Bachand

[57] ABSTRACT

Product for softening clothing and fabric articles in a rotating drum dryer comprising a moist air permeable packet partly filled with particulate softening agent which is tumbled with the fabrics in a manner repeatedly renewing the agent surfaces exposed to generated moist air to condition said air in fabric softening relation.

10 Claims, 3 Drawing Figures

Fig. 1.
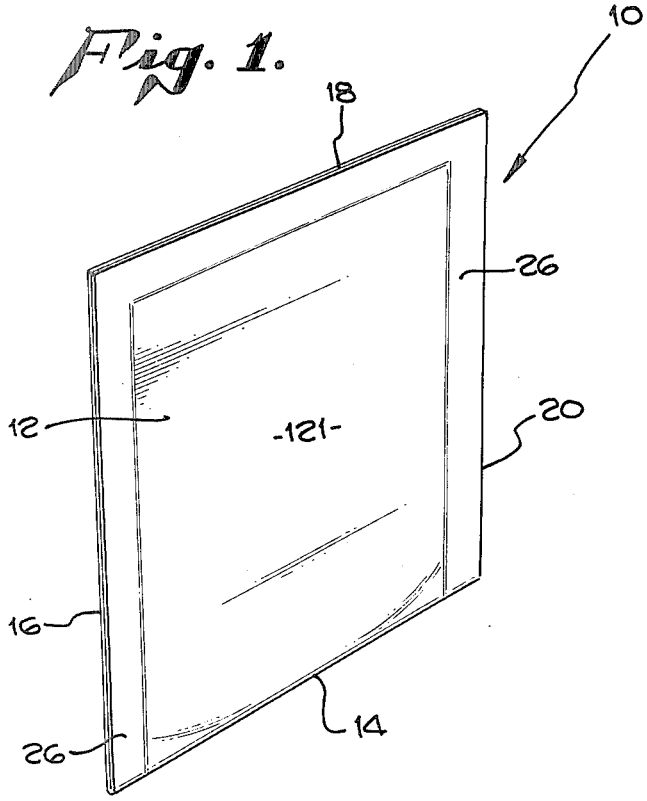
Fig. 3.
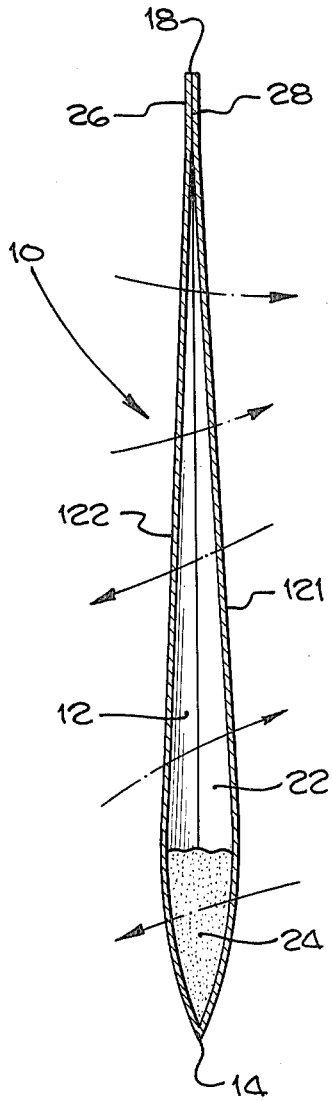
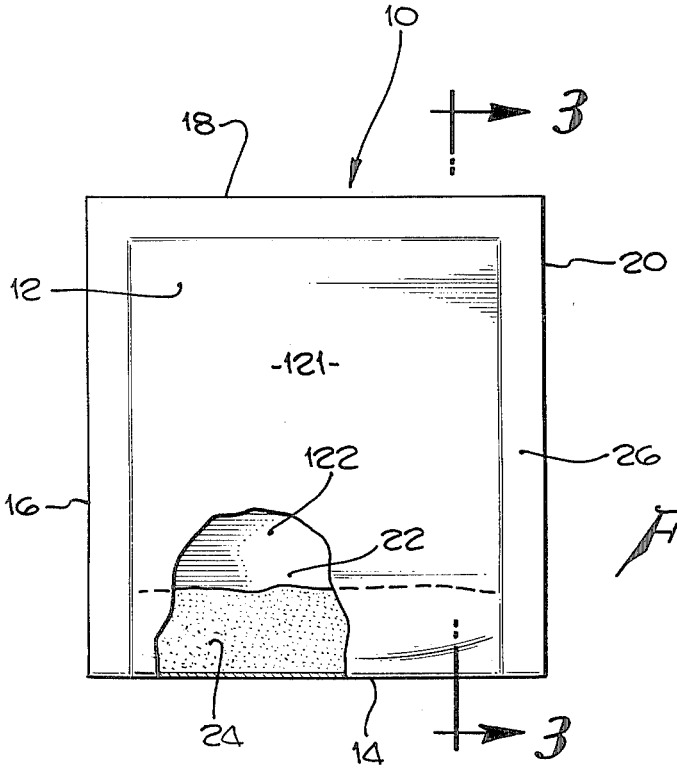
Fig. 2.

FABRIC SOFTENING PRODUCT AND METHOD OF USE IN DRYER

BACKGROUND OF THE INVENTION

This invention has to do with improving the "hand" or softness of clothing and like fabrics including shirts, dresses, bedding, towels, linens, children's clothes, and baby articles. More particularly, the invention is concerned with a product for accomplishing the softening of clothing and like fabric articles during the drying of such articles.

Fabric "hand" is a quality more easily discerned than measured. Generally, good "hand" in a fabric is the property of feeling comfortably soft to the touch, smoothly draping when held, and essentially free of roughness or excess static electricity. Commercially the term "fabric softness" has been widely substituted for "hand" and numerous products are sold as "fabric softeners," often to remedy the effects of washing with detergents vended by the same manufacturers.

PRIOR ART

Consumer convenience is a watchword in any commercial marketing program, and it is in this area that the currently most popular fabric softeners are deficient. Popular current fabric softeners are typically liquids which are added, at selected times, to the washing machine, in the course of the washing-rinsing cycle. While the top-of-the-line washing machines may have provisions for adding fabric softener at the right time during the cycle, many, if not most, automatic washing machines do not. Accordingly, the housewife must be present, and alert to cycle progress, to effect softener addition at the right time. See U.S. Pat. Nos. 3,507,690 and 3,681,241.

More recently, there have been introduced fabric softener products which avoid the washing machine altogether. These relatively recently commercialized products are used in the dryer, being affixed to the dryer drum or laid among the clothing and fabric articles to tumble about with the clothes during drying thereof. See U.S. Pat. No. 3,442,692.

While the theory of fabric softening is not well established, softening appears to derive at least in part from a conditioning of the air or rinse water ambient about the clothing and fabric articles in a manner depositing positive charges onto the fabric fibers; such like charges mutually repelling each other, they, in effect, puff or fluff the adjacent fibers by apparently tending to separate them.

For the most part softening agents useful in the prior art and herein are known. They are characterized by highly available positive charges, and typically include tertiary amines, and particularly quaternary ammonium compounds.

SUMMARY OF THE INVENTION

It is with the more effective conditioning of the moist air within a dryer, and the provision of a product peculiarly adapted thereto that the present invention is particularly concerned. The dryer air "conditioning" involves the addition to the ambient moist air within the dryer of positive charges for deposit onto the fabric articles in softening amounts, e.g., from 500 to 5000 parts of softening agent per million parts by weight of fabric to be softened. The positive charges are derived in this invention as in the prior art from known softening agents, primarily quaternary ammonium compounds, preferably normally solid, or liquid such compounds absorbed onto a suitable carrier, such as talc, diatomaceous earth, or like natural or synthetic highly absorbent, heat resistant, water and chemically inert, particulate material; or adducts of ammonium compounds with e.g. urea.

Because of the need to transfer positive charges from the softening agent to the fabric articles, by conveyance through moist air within the dryer, the surface area of the softening agent must be maximized to the extent possible, and accordingly herein finely divided, highly particulate softening agent is preferred.

In addition, characteristically of the present invention, and unlike prior art in-dryer fabric softener aids, the above particulate softening agent is loosely confined within a location within the dryer, free to arrange and rearrange itself innumerable times in the course of tumbling in the dryer, each time charging the surfaces of the softening agent that are air exposed, not only increasing the surface exposure of positive charges carried by the agent to dryer moist air at any given time, but continually renewing the surface exposed over the course of time and greatly multiplying the effective surface exposure.

More particularly, the invention provides for use in softening of clothing and like fabric articles in a rotating drum dryer, the product comprising a particulate softening agent adapted to condition fabric in softening relation within the dryer drum by surface contact with the softening agent of dryer moist air, and a packet defining a moist air permeable movable locus of confinement for the softening agent within the dryer drum; the packet being adapted to prevent softening agent contact with the fabric articles and to provide free flow of agent particles within the defined locus, whereby the softening agent randomly assumes different attitudes of repose responsive to drum rotation and repeatedly varies the surfaces of the softening agent exposed to moist air permeating the defined locus.

In particular embodiments, the fabric softening product packet may define a locus of a volume not less than five times the volume of the softening agent, may be formed of water resistant paper, e.g., may comprise a moisture non-absorbent paper web folded on itself and sealed at the open sides; or more particularly the packet may comprise nonabsorbent, moisture vapor permeable, flat, paper sidewalls in opposed relation and perimetrically joined to define the locus.

Typically the softening agent may have a particle size between 60 and 200 U.S. mesh, and comprise as the active ingredient a quaternary ammonium compound.

The invention further contemplates a method of softening clothing and like fabric articles in a rotating drum dryer, which includes carrying along with the fabric articles tumbling in the drum a free-flowing softening agent in a packet defining a traveling, e.g., freely tumbling locus of confinement therefor, passing moist air generated in the dryer through packet in contact with the softening agent in different attitudes of repose within the locus responsive to drum rotation to condition the moist air in fabric softening relation.

BRIEF DESCRIPTION OF THE DRAWINGS

The invention will be further described as to an illustrative embodiment in conjunction with the attached drawing, in which:

FIG. 1 is a perspective view of the product of the invention;

FIG. 2 is a front elevation view thereof, the packet being partly broken away to reveal the softening agent therewithin; and FIG. 3 is a view taken on line 3—3 of FIG. 2.

DESCRIPTION OF THE PREFERRED EMBODIMENT

With reference first to the drawings in detail, the packet 10 comprises a web material 12 folded on itself at 14 into a U-shape to form sidewalls 121, 122 secured at their open sides 16, 18, and 20 to form a two-walled pouch defining a confined space 22 which is the locus of confinement for particulate softening agent 24. It will be observed that the enclosed volume of the space 22 is not less than five times the volume of contained softening agent 24.

The sidewalls 121, 122 are moist air permeable, at least partially, to provide a path for moist air within a dryer, generated by the heating action of the dryer on water remaining on the recently washed clothing and fabric articles within the dryer. It is to be noted that the term "moist air" herein has reference to ambient atmospheric air with measurable humidity as may be contributed by evaporation of water from clothing articles within the dryer, i.e., air containing moisture vapor. The "conditioning" of such moist air "in fabric softening relation," refers herein to the transient addition to moist air of small but effective amounts of softening agent positive charges and for release into or deposit onto dryer tumbling fabrics to improve the "hand" of such fabrics, as described above. Other mechanisms of "softening" of fabric may be operating as well during the performance of the herein described product of the invention and accordingly, the term "condition" is to be understood to be inclusive of the described and other forms of passing the separable softening agent effective adjuvants, from their repose within the packet 10 out of direct, physical contact with the fabrics to be softened by virtue of walls 121, 122, to the fabric textile fibers, for softening effect.

The packet 10 may be a single web of material folded on itself as shown or multiple pieces of material (not shown), the material being suitably abrasion resistant, nonabsorbent with respect to water or moisture vapor, at least to the degree necessary for integrity of the packet walls during tumbling in the dryer for the usual period of time, nonreactive or inert with respect to detergent and water, and not heat sensitive. Paper is a highly suitable wall material if waterproof or not excessively moisture vapor absorptive. Resin coated papers are preferred. Cloth, of natural or synthetic fibers, woven or unwoven, is likewise suitable if the foregoing resistance to dryer environment criteria are met.

The sidewalls 121, 122 are joined together by any suitable means, determined by their material of construction. Paper and cloth may be glued, sewn, or stapled or otherwise fastened together, providing the resulting enclosed or confined space 22 is thereby retentive of the particulate softening agent.

In the embodiment shown in the drawing a moisture proofed paper web is perimetrically sealed at 26 by glue line 28 to define the locus of softening agent 24 confinement, space 22. The sidewalls 121, 122 are sufficiently porous to provide a flow path for moist air through space 22 (see dashed arrows), a portion of which intersects with the softening agent 24, varying with the distribution and assumed attitude of repose of the agent.

Suitable softening agents herein are warm, moist air responsive to yield positive charges for deposit onto the fabric articles. In use, the initially particulate agent may cohere into a unitary mass, depending on moisture content of the air, the specific agent being employed and the presence or absence of a dispersing aid such as talc. Typically such coherence does not affect fabric softening performance.

The fabric softening agents particularly useful herein, in chemical terms, are organic amines, e.g., teritary amines and quaternarized amines, the latter being generally referred to as quaternary ammonium compounds.

The term softening agent herein is not limited to any particular agent or chemical species. Most suitable agents are like the amines mentioned above, cationic. Some anionics such as calcium and magnesium salts of ordinary fatty acids of 14 to 18 carbon atoms chain length are also effective. Some of the amphoteric molecules are also effective.

The requirements for a fabric softening agent essentially are: (1) one or more hydrophobic side chains of 14 to 18 carbon atoms in length; and (2) a positively charged end to serve as a joint of attachment to the negatively charged molecule of the fiber.

Typical fabric conditioners include:

(a) Primary, secondary, and tertiary amines and their water soluble or water dispersible salts. For example:

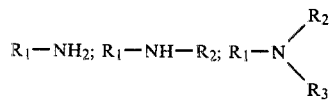

where $R_1$ and/or $R_2$ may be an alkyl group of 16 to 18 carbon atoms or any equivalent group with comparable hydrophobicity.

(b) A quaternary nitrogen-containing base or salt. For example:

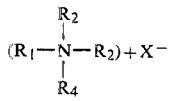

where X may be any one of the following groups: $OH^-$, $Cl^-$, $Br^-$, $HSO_3^-$, $SO_4^-$ or similar negative radicles, and where $R_1$ and $R_2$ may be as in (a) (a) above and $R_3$ and $R_4$ are methyl or ethyl groups.

(c) Alkyl imidazolines and imidazoles.

(d) Alkyl pyridine and piperidine salts.

(e) Alkyl sulfonium salts.

(f) Alkyl phosphonium salts.

(g) Esters of amino acids.

(h) Esters of amino alcohols.

(i) Alkyl guanidines and their salts.

As in the earlier mentioned U.S. Pat. No. 3,442,652 the useful softening agent for in-dryer use is one of the foregoing, or the like which is moist air conditioning in fabric softening relation within the dryer.

What is claimed is:

1. For use in softening of clothing and like fabrics in a rotating drum dryer, the product comprising (a) a free-flowing particulate softening agent for conditioning fabric in softening relation within the dryer drum, said agent yielding positive charges to the ambient moist air in said dryer upon contact of the agent surface with said air; and (b) a packet having moist air permeable sidewalls defining a freely tumbling locus of loose confinement for said agent within said drum, said packet sidewalls preventing direct, physical contact of said agent with said fabric articles while permitting free flow of agent particles within said locus, whereby said agent particles randomly assume different attitudes of repose responsive to drum rotation and repeatedly varying the surfaces of the agent exposed to moist air permeating said locus.

2. The fabric softening product according to claim 1 in which said packet is formed of water resistant paper.

3. The fabric softening product according to claim 1 in which said packet defines a locus of a volume not less than five times the volume of said agent.

4. The fabric softening product according to claim 1 in which said packet comprises a moisture nonabsorbent paper web folded on itself and sealed at the open sides.

5. The fabric softening product according to claim 1 in which said agent has a particle size between 60 and 200 U.S. mesh.

6. The fabric softening product according to claim 5 in which said packet defines a locus of a volume not less than five times the volume of said agent.

7. The fabric softening product according to claim 6 in which said packet comprises moisture nonabsorbent, moisture vapor permeable, flat sidewalls in opposed relation and perimetrically joined to define said locus.

8. The fabric softening product according to claim 7 in which said agent comprises a quaternary ammonium compound.

9. The fabric softening product according to claim 8 in which said sidewalls are paper.

10. Method of softening clothing and like fabric articles in a rotating drum dryer which includes (a) carrying along with the fabric articles tumbling in the drum a free-flowing particulate softening agent in a packet having moisture-permeable side walls and defining a freely tumbling locus of loose confinement therefor out of direct, physical contact with said articles, said agent yielding positive charges to the ambient moist air in said dryer upon contact of the agent surface with said air; and (b) passing moist air generated in the dryer through said packet in contact with said agent in tumbling induced different attitudes of agent particle repose within said locus responsive to drum rotation to condition said air by the addition thereto of positive charges of said softening agent, whereby said articles are softened by contact with the conditioned air.

* * * * *